US007556421B2

(12) United States Patent
Lindbeck et al.

(10) Patent No.: US 7,556,421 B2
(45) Date of Patent: Jul. 7, 2009

(54) VIBRATORY APPARATUS AND METHOD FOR SETTLING THE CONTENTS OF A CONTAINER

(75) Inventors: Michael J. Lindbeck, Algonac, MI (US); John J. Valuet, Commerce, MI (US)

(73) Assignee: Martin Engineering Company, Neponset, IL (US)

( * ) Notice: Subject to any disclaimer, the term of this patent is extended or adjusted under 35 U.S.C. 154(b) by 15 days.

(21) Appl. No.: 11/869,226

(22) Filed: Oct. 9, 2007

(65) Prior Publication Data

US 2008/0025141 A1 Jan. 31, 2008

Related U.S. Application Data

(62) Division of application No. 10/978,762, filed on Nov. 1, 2004, now Pat. No. 7,300,195.

(51) Int. Cl.
*B01F 11/00* (2006.01)

(52) U.S. Cl. ..... 366/114; 366/124

(58) Field of Classification Search ..... 366/109–112, 366/114, 115, 124, 212; 198/765, 768
See application file for complete search history.

(56) References Cited

U.S. PATENT DOCUMENTS

| | | | | |
|---|---|---|---|---|
| 807,709 | A | 12/1905 | Barber | |
| 1,978,606 | A | 10/1934 | Sloane | |
| 2,255,799 | A | 9/1941 | Meinzer | |
| 2,458,387 | A | 1/1949 | Kindseth | |
| 2,775,987 | A * | 1/1957 | Bohlman et al. | 141/12 |
| 3,167,304 | A | 1/1965 | Lemmond | |
| 3,344,579 | A | 10/1967 | Gentry et al. | |
| 3,576,313 | A | 4/1971 | Derderian | |
| 3,945,246 | A * | 3/1976 | Wadensten | 73/666 |
| 4,194,668 | A * | 3/1980 | Akyurek | 228/6.2 |
| 4,194,688 | A | 3/1980 | Cobos | |
| 4,282,091 | A | 8/1981 | Carter, Sr. | |
| 4,483,621 | A | 11/1984 | Kreiskorte | |
| 4,744,195 | A | 5/1988 | Reed | |
| 4,987,727 | A | 1/1991 | McClusky et al. | |
| 5,115,619 | A * | 5/1992 | Lieder | 53/459 |

(Continued)

OTHER PUBLICATIONS

Martin Vibration Systems and Solutions, NTS Non-Impacting Linear Vibrators, 2001, USA.

(Continued)

*Primary Examiner*—David L Sorkin
(74) *Attorney, Agent, or Firm*—Thompson Coburn LLP; Clyde L. Smith

(57) ABSTRACT

A vibratory apparatus and method for settling the contents of a container. The vibratory apparatus includes a base and a load table located above the base. A plurality of resiliently flexible vertical support members attach the load table to the base. A pneumatic linear vibrator is attached to the load table and is adapted to the vibrate the load table along a line of stroke that is generally linear and generally horizontal. One or more vacuum cups are attached to the top of the load table to releasably secure the container to the load table for vibration. The vibrator can independently vary the amplitude and the frequency of the vibration of the container to maximize settling of wllthe contents of the container.

5 Claims, 3 Drawing Sheets

U.S. PATENT DOCUMENTS 5,259,672 A 11/1993 Rowe
5,312,280 A * 5/1994 Kloba et al. ..... 445/59
5,427,451 A 6/1995 Schmidt
6,508,582 B2 1/2003 Friedman
2003/0081499 A1 5/2003 Friedman

OTHER PUBLICATIONS

Martin Vibration Systems and Solutions, NTK Oscillators, 2001, USA.

* cited by examiner

VIBRATORY APPARATUS AND METHOD FOR SETTLING THE CONTENTS OF A CONTAINER

Related Applications

This application is a division of Application Ser. No. 10/978,762, filed Nov. 1, 2004.

BACKGROUND

The present disclosure is directed to a vibratory apparatus and method for settling the contents of a container, and in particular to a vibratory apparatus including a vibrator, one or more coupling members that selectively secure the container to the vibratory apparatus, and a plurality of resiliently flexible support members that enable the coupling members and the container to be vibrated along a generally linear and generally horizontal line of stroke to settle the contents of the container.

Vibratory tables have been used to compact or settle the contents of a container. Prior vibratory tables typically provided vibratory motion along a line of stroke that is vertical or nearly vertical. The container and its contents were therefore lifted as they were vibrated thereby requiring a large expenditure of energy. It is also often difficult to settle the contents of a container that is vibrated vertically when the contents is irregular in shape or has a light bulk density.

SUMMARY

A vibratory apparatus and method for settling the contents of a container. The vibratory apparatus includes a base and a load table located above the base. The load table is movable with respect to the base along a line of stroke that is generally linear and generally horizontal. A plurality of resiliently flexible support members are coupled at a first end to the base and at a second end to the load table. Each support member is generally more rigid in a direction transverse to the line of stroke than the support member is rigid along the line of stroke. Each support member comprises a generally planar plate-like member. One or more coupling members, such as vacuum cups, are attached to the top of the load table. Each coupling member is adapted to releaseably secure the container to the load table. A linear pneumatic vibrator is attached to the bottom of the load table. The vibrator is adapted to vibrate the load table and the container along the line of stroke to thereby settle the contents of the container. The linear pneumatic vibrator allows for the selective adjustment of the amplitude of the vibratory motion of the container, and the selective adjustment of the frequency of the vibratory motion of the container, independently of one another.

BRIEF DESCRIPTION OF THE DRAWING FIGURES

DETAILED DESCRIPTION

Figure 1:
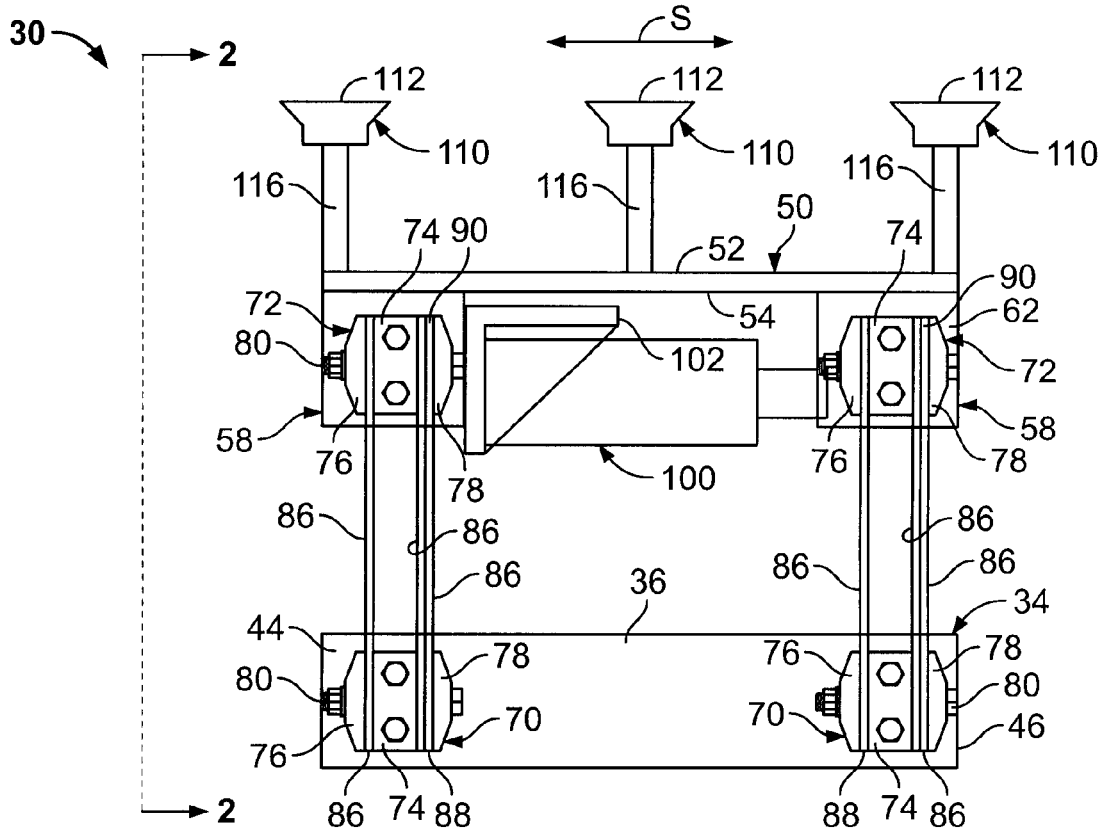
FIG. 1 is a front elevational view of the vibratory table of the vibratory apparatus.

The vibratory apparatus 20 as shown in the drawing figures is adapted to vibrate a container 22 and the contents of the container back and forth along a line of stroke, as generally shown by the arrow "S", that is generally linear and generally horizontal. The container 22 includes a generally planar bottom wall 24 and a peripheral side wall 26 extending upwardly from the bottom wall 24. The walls 24 and 26 form a chamber adapted to receive the contents of the container. The container 22 may, for example, be a box or a carton. The container 22 may be formed from materials such as, for example, paper, cardboard, metal, plastic and the like. The contents of the container may be, for example, various types of bulk material, packaged products, packaged food products, irregular shaped products, and products having a light bulk density.

Figure 2:
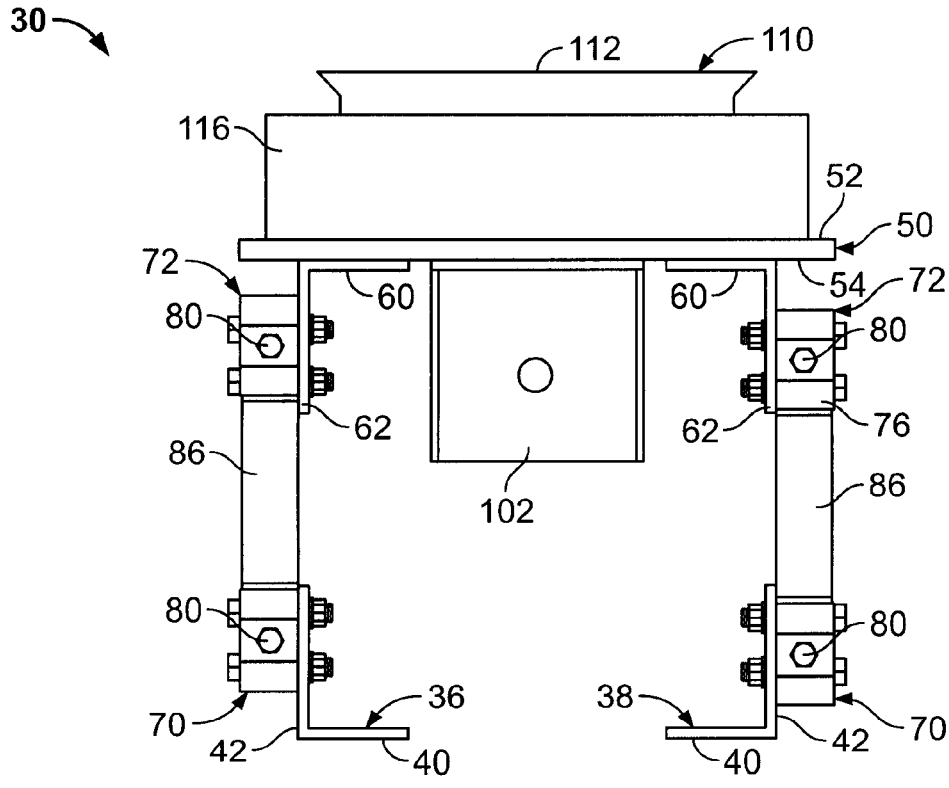
FIG. 2 is a side elevational view taken along line 2-2 of FIG. 1.

The vibratory apparatus 20 includes a vibratory table 30 and a conveyor mechanism 32. As shown in FIGS. 1 and 2, the vibratory table 30 includes a base 34 that is adapted to be supported on a stationary structure such as, for example, a concrete floor. The base 34 may be removably attached to the floor to prevent relative movement of the base 34 with respect to the floor. As shown in FIG. 2, the base 34 comprises a first base member 36 and a second base member 38. Each base member 36 and 38 includes a generally horizontal leg 40 and a generally vertical leg 42 arranged in a generally L-shaped manner. Each base member 36 and 38 extends generally linearly between a first end 44 and a second end 46. If desired, the first and second base members 36 and 38 may be connected to one another by one or more transverse members. The base 34 may also alternately comprise a generally planar plate having a plurality of vertical legs 42.

The vibratory table 30 includes a load table 50 located vertically above the base 34. The load table 50 includes a top 52 and a bottom 54. The load table 50 includes a platform 56 having a generally planar top surface and a generally planar bottom surface. The platform 56 is disposed generally horizontal and is generally rectangular such that the platform 56 has four generally linear edges. A plurality of brackets 58 are attached to the bottom surface of the platform 56. Each bracket 58 is located adjacent a respective corner of the platform 56. Each bracket 58 includes a generally horizontal leg 60 that is attached to the platform 56 and a downwardly extending generally vertical leg 62. The vertical legs 62 of two brackets 58 are generally vertically aligned with the vertical leg 42 of the first base member 36, and the vertical legs 62 of two brackets 58 are generally vertically aligned with the vertical leg 42 of the second base member 38. If desired, two or more brackets 58 can be connected to one another as a single bracket.

A plurality of first mounting members 70 are respectively attached to each end 44 and 46 of the first base member 36, and to each end 44 and 46 of the second base member 38. A plurality of second mounting members 72 are respectively attached to each bracket 58 of the load table 50. Each second mounting member 72 is located generally vertically above a respective first mounting member 70. Each mounting member 70 and 72 includes a lug 74 that is attached to the base 34 or bracket 58 by one or more fasteners. Each lug 74 includes a pair of generally vertical and planar surfaces that are spaced apart and generally parallel to one another. Each mounting member 70 and 72 also includes a first retainer member 76 and a second retainer member 78. The first retainer member 76 includes a generally planar and vertical surface that is adapted to be located adjacent the first vertical surface of the lug 74. The second retainer member 78 includes a generally planar and vertical surface that is adapted to be located adjacent the second vertical surface of the lug 74. The first and second retainer members 76 and 78 are removably attached to the lug 74 by a fastener 80, such as for example a threaded bolt and nut, that extends through the lug 74 and retainer members 76 and 78. The lug 74 and retainer members 76 and 78 may be made from nylon or other plastic and metal materials.

The vibratory table 30 also includes a plurality of resiliently flexible vertical support members 86. Each support member 86 is a generally plate-like member having a first end 88 and a second end 90. The first end 88 of each support member 86 is coupled to a first mounting member 70 and the second end 90 of the support member 86 is coupled to a second mounting member 72. One or more support members 86 can be coupled to each first mounting member 70 and second mounting member 72 as desired. One or more support members 86 may be coupled to the mounting members 70 and 72 between the lug 74 and the first retainer member 76. One or more support members 86 may also be coupled to the mounting members 70 and 72 between the lug 74 and the second retainer member 78. The support members 86 that extend between a first mounting member 70 and a second mounting member 72 form a resiliently flexible leaf spring. Each support member 86 is more rigid in a direction perpendicular to the line of stroke than the support member 86 is rigid along the line of stroke. The support members 86 are adapted to allow the load table 50 to vibrate back and forth along the line of stroke while inhibiting movement of the load table 50 in a direction perpendicular to the line of stroke.

The support members 86 may be formed from fiberglass, plastic, metal and other materials. Each support member 86 may be, as an example, approximately three-sixteenths of an inch thick, approximately one inch wide, and approximately ten inches long. The thickness and length of each support member 86 may be varied as desired to adjust its flexibility. The number of support members 86 that connect each second mounting member 72 to a respective first mounting member 70 may be selectively adjusted, by adding or deleting support members 86, and the size and rigidness of the support members 86 may be selected, to tune the vibratory motion of the load table 50 such that the load table 50 vibrates in resonance.

The vibratory table 30 includes a vibrator 100 that is attached to the bottom 54 of the load table 50 by a mounting bracket 102. The vibrator 100 may be a linear vibrator and may be a pneumatically operated vibrator. The vibrator 100 may be an NTK® Series non-impacting linear oscillator of Martin Vibration Systems and Solutions. The vibrator 100 is connected in fluid communication with a valve and a source of pressurized gas, such as air (not shown).

Figure 4:
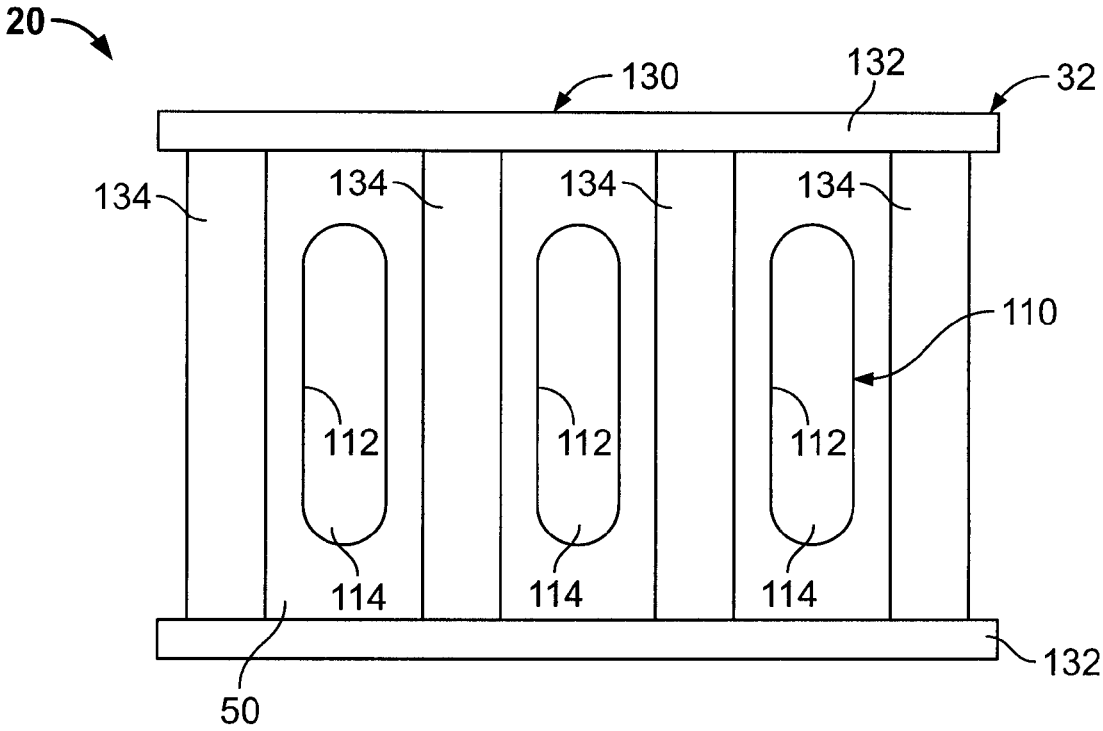
FIG. 4 is top plan view of the vibratory apparatus.

The vibratory table 30 includes one or more coupling members such as, for example, vacuum cups 110. Each vacuum cup 110 includes an upper peripheral edge 112 and a chamber 114 having an open top formed by the peripheral edge 112. The upper peripheral edges 112 of the vacuum cups 110 are located in a common generally horizontal plane. The chamber 114 of each vacuum cup 110 is connected in fluid communication with a vacuum pump and valve (not shown). As shown in FIG. 4, each vacuum cup 110 is elongate in a direction generally transverse to the line of stroke. As shown in drawing figures, three vacuum cups 110 are attached to and supported by the top 52 of the load table 50. However, fewer vacuum cups or additional vacuum cups may be used. Each vacuum cup 110 is attached to the top 52 of the load table 50 by a respective spacer member 116. Each spacer member 116 positions a respective vacuum cup 110 at a location that is spaced apart from and above the top 52 of the load table 50. Each spacer member 116 may be a generally C-shaped member, a plate, one or more posts, or other types of members. Each spacer member 116 may include an adjustment mechanism for vertically adjusting the position of the vacuum cup 110 with respect to the load table 50 to provide proper horizontal alignment of each vacuum cup 110 with respect to the other vacuum cups.

As shown in FIGS. 3-6, the conveyor mechanism 32 includes a stand 124 having a plurality of vertical legs 126 and a generally horizontal top member 128. The conveyor mechanism 32 also includes a conveyor table 130 having two spaced apart generally parallel and horizontal side rails 132. A plurality of generally cylindrical rollers 134 extend transversely between the side rails 132 and are rotatably mounted thereto such that each roller 134 is rotatable about its central longitudinal axis with respect to the side rails 132. The tops of the rollers 134 form a generally horizontal conveying plane 136 along which the container 22 is adapted to horizontally roll on top of the rollers 134 from a first end of the conveyor table 130 to a second end of the conveyor table 130.

Figure 3:
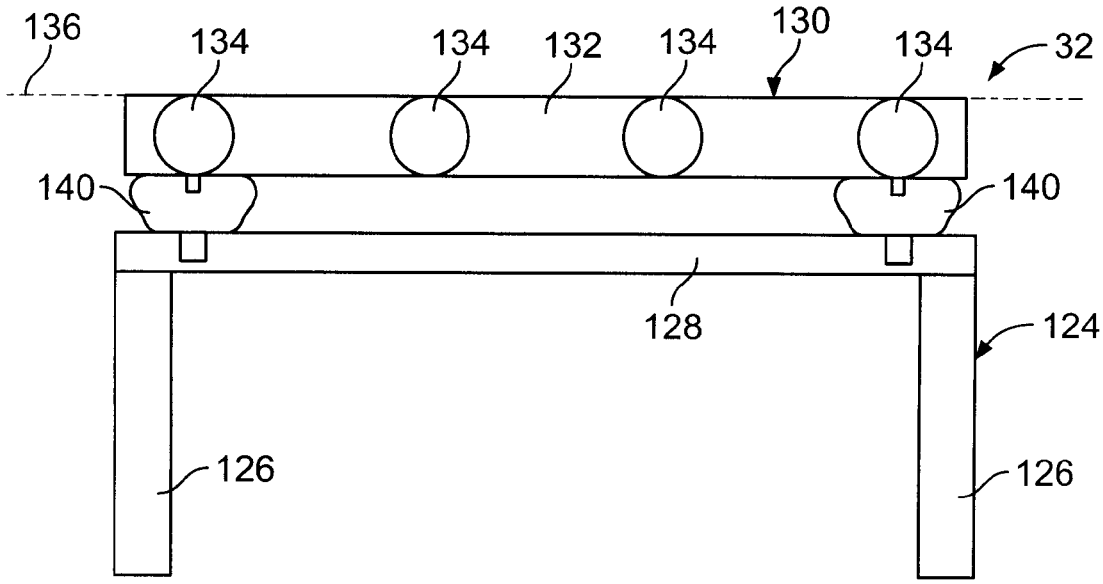
FIG. 3 is front elevational view of the conveyor mechanism of the vibratory apparatus.
Figure 5:
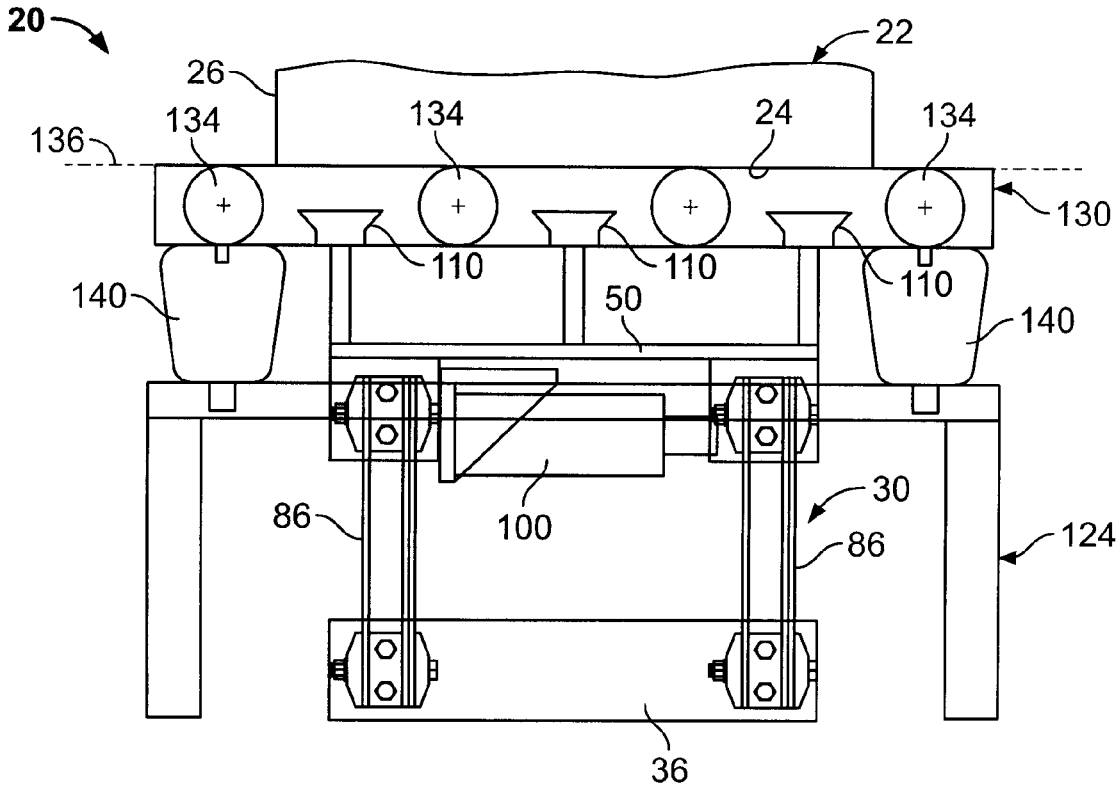
FIG. 5 is a front elevational view of the vibratory apparatus with the conveyor table shown in the raised position.
Figure 6:
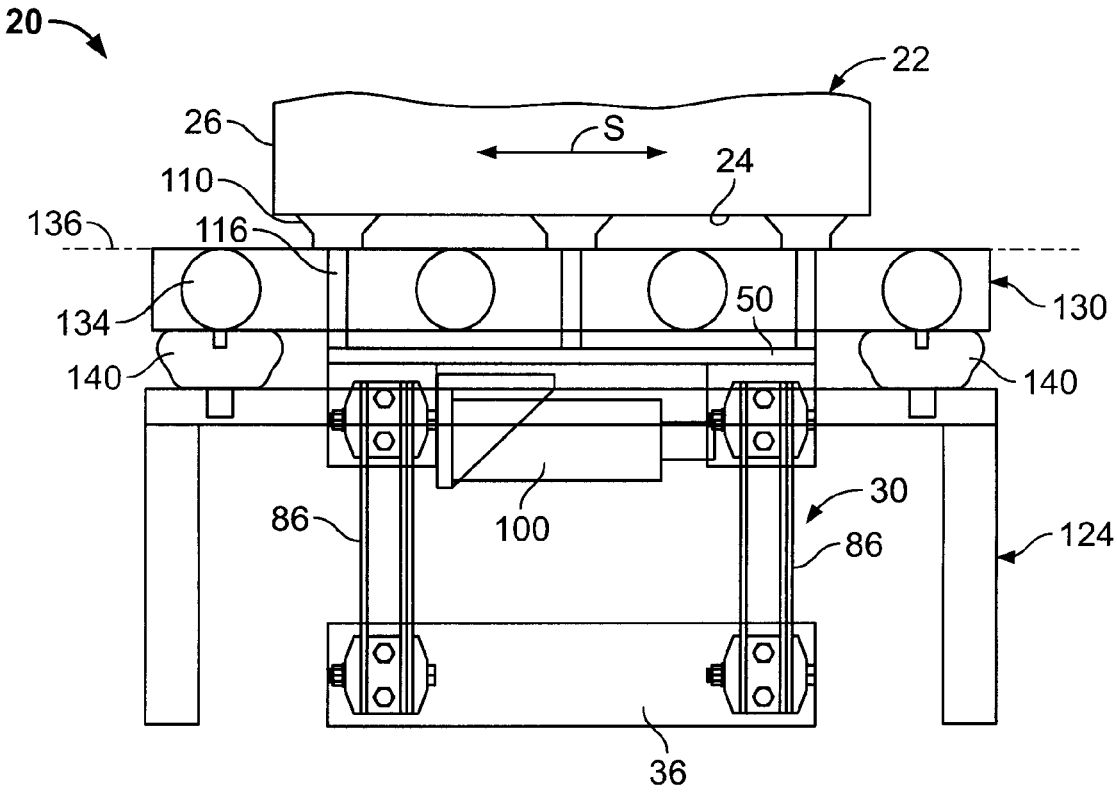
FIG. 6 is a front elevational view of the vibratory apparatus with the conveyor table shown in the lowered position.

The conveyor table 130 is attached to and supported on the stand 124 by a plurality of lift mechanisms 140. Each lift mechanism 140 may be a pneumatic bladder having a bottom end attached to the stand 124 and a top end attached to the conveyor table 130. Each lift mechanism 140 is connected in fluid communication with a source of pressurized gas, such as air, and a valve (not shown). Compressed gas is fed into the lift mechanisms 140 to lift or raise the conveyor table 130 with respect to the stand 124 and vibratory table 30 to a raised position as shown in FIG. 5. Gas is released from the lift mechanisms 140 to lower the conveyor table 130 with respect to the stand 124 and vibratory table 30 to a lowered position, which is lower in elevation than the raised position, as shown in FIGS. 3 and 6.

In operation, the conveyor table 130 is moved to the raised position as shown in FIG. 5 such that the vacuum cups 110 are located below the conveying plane 136. A container 22 is then moved from an adjacent conveyor onto the conveyor table 130. The container 22 is rolled horizontally on the rollers 134 to a position as shown in FIG. 5 wherein the container 22 is located vertically above the vacuum cups 110. Gas is then released from the lift mechanisms 140 such that the conveyor table 130 is moved downwardly to the lowered position as shown in FIG. 6. Once the conveyor table 130 is moved to the lowered position as shown in FIG. 6, the vacuum cups 110 are located vertically above the conveying plane 136 and are respectively located between adjacent rollers 134 at an elevation higher than the elevation of the tops of the rollers 114. As the vacuum cups 110 begin to project upwardly through the conveying plane 136, the container 22 rests upon and is supported by the vacuum cups 110 and the load table 150, such that the vacuum cups 110 are in engagement with the bottom wall 24 of the container 22.

A pump removes gas from the chambers 114 of the vacuum cups 110 such that the pressure of the gas within in the chambers 114 is lower than atmospheric pressure and such that at least a partial vacuum is created within the chamber 114. The suction provided by the vacuum cups 110, due to the vacuum created in the chambers 114, releasably secures the container 22 to the load table 50. Compressed gas is then supplied to the vibrator 110 whereupon the vibrator vibrates the load table 50, the vacuum cups 110, and the container 22 and its contents back and forth along the line of stroke in a generally horizontal and generally linear direction. The linear and horizontal vibratory motion that is supplied to the container 22 settles and compacts the contents of the container.

The vibratory motion along the line of stroke is energy efficient as the container and its contents are not lifted during vibration.

The resiliently flexible support members 86 allow the load table 50 and container 22 to vibrate along the line of stroke while inhibiting movement of the table 50 and container 22 in a direction transverse to the line of stroke or rotationally about a vertical axis. The support members 86 thereby stabilize the vibratory motion of the load table 50 and container 22. As the load table 50 and container 22 generally pivot about the first ends 88 of the support members 86, the load table 50 and container generally move along a shallow arc-shaped path which is considered to be generally linear herein.

The supply of compressed gas to the vibrator 110 is then stopped such that the vibrator 100 no longer provides a vibratory force to the load table 50. Once the vibratory motion of the load table 50 and container 22 is substantially stopped the chambers 114 of the vacuum cups 110 are then placed in fluid communication with the atmosphere to break the vacuum within the chambers 114 and the suction created between the vacuum cups 110 and the container 22. The container 22 is then vertically supported on the vacuum cups 110 but is no longer secured to the vacuum cups 110. Compressed gas is then supplied to the lift mechanisms 140. The lift mechanisms 140 raise the conveyor table 130 from the lowered position as shown in FIG. 6 to the raised position as shown in FIG. 5 thereby lifting the container 22 upwardly from the vacuum cups 110. The container 22 and its settled contents may then be moved horizontally off of the conveyor table 130 to an adjacent conveyor mechanism or other apparatus for handling the container 22.

The pneumatic linear vibrator 110 enables the amplitude of the vibratory motion of the container 22 along the line of stroke, which is the horizontal distance that the container 22 travels, to be selectively adjusted independently of the frequency of the vibrator motion. Similarly, the frequency of the vibratory motion of the container 22, which is the time it takes the container 22 to complete a cycle of movement along the line of stroke, can also be selectively adjusted by the vibrator 100 independently of the amplitude of the vibratory motion. If desired, both the frequency and the amplitude of the vibratory motion along the line of stroke can be simultaneously adjusted.

The number of support members 86 that are used and the size and flexibility of the support members 86 can be selected as desired, and the frequency and amplitude of the vibratory motion of the table top 50 and container 22 can be adjusted by the vibrator 100 as desired, to tune the vibratory motion of the table top 50 and container 22 such that the table top 50 and container 22 vibrate in resonance. When the vibratory table 30 vibrates the container 22 in resonance the settling of the contents of the container is maximized and magnified. Operation of the vibratory table 30 can be tuned to match the weight or mass of the container 22 and its contents, to provide the type of vibratory motion to the container 22 that is most effective to settle the contents of the container.

The vibratory apparatus 20 has been described above as including lift mechanisms 140 that raise and lower the conveyor table 130 to selectively position the container 22 on the vacuum cups 110. Alternatively, the lift mechanisms 140 can be placed between the base 34 of the vibratory table 30 and a supporting floor structure such that the lift mechanisms selectively raise and lower the vibratory table 30 while the conveyor table 130 remains stationary. Alternatively, the lift mechanisms can be placed between the vacuum cups 110 and the load table 50 to selectively raise or lower the vacuum cups 110 with respect to the conveyor table 130 while the load table 50 and the conveyor table 130 remain stationary.

Various features of the invention have been particularly shown and described in connection with the illustrated embodiment of the invention, however, it must be understood that these particular arrangements merely illustrate, and that the invention is to be given its fullest interpretation within the terms of the appended claims.

What is claimed is:

1. A method for vibrating the contents of a container such that the contents settle within the container, said method comprising the steps of:

providing a vibratory apparatus including one or more vacuum cups and a linear vibrator for vibrating said vacuum cups along a line of stroke that is generally linear and generally horizontal;

placing said container in engagement with said vacuum cups;

securing said container to said vacuum cups by creating at least a partial vacuum between said vacuum cups and the container;

vibrating the container and its contents along said line of stroke to settle the contents of the container; and releasing said container from said vacuum cups.

2. The method of claim 1 wherein said vibrator is pneumatically operated.

3. The method of claim 1 including the steps of:

providing a conveyor table including a plurality of rollers for locating the container above the vacuum cups;

positioning said vacuum cups above said rollers such that the container is supported by said vacuum cups for vibration;

positioning said rollers above said vacuum cups after vibration of the container such that the container is supported by said rollers.

4. The method of claim 1 including selectively adjusting the amplitude of the vibratory motion of the container independently of the frequency of the vibratory motion of the container.

5. The method of claim 1 including selectively adjusting the frequency of the vibratory motion of the container independently of the amplitude of the vibratory motion of the container.

* * * * *